US010161250B2

(12) United States Patent
Forcier et al.

(10) Patent No.: US 10,161,250 B2
(45) Date of Patent: Dec. 25, 2018

(54) ROTOR WITH AXIAL ARM HAVING PROTRUDING RAMP

(71) Applicant: United Technologies Corporation, Hartford, CT (US)

(72) Inventors: Matthew P. Forcier, South Windsor, CT (US); Brian J. Schuler, West Hartford, CT (US); Jordan T. Wall, Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 757 days.

(21) Appl. No.: 14/618,041

(22) Filed: Feb. 10, 2015

(65) Prior Publication Data

US 2016/0230559 A1 Aug. 11, 2016

(51) Int. Cl.

| | |
|---|---|
| ***F01D 5/02*** | (2006.01) |
| ***F01D 9/04*** | (2006.01) |
| ***F01D 25/24*** | (2006.01) |
| ***F01D 11/00*** | (2006.01) |
| ***F01D 11/02*** | (2006.01) |
| ***F04D 29/16*** | (2006.01) |
| ***F04D 29/54*** | (2006.01) |

(52) U.S. Cl.

CPC ..... *F01D 5/02* (2013.01); *F01D 9/041* (2013.01); *F01D 11/001* (2013.01); *F01D 11/005* (2013.01); *F01D 11/02* (2013.01); *F01D 25/24* (2013.01); *F04D 29/164* (2013.01); *F04D 29/542* (2013.01); *F05D 2240/12* (2013.01); *F05D 2240/80* (2013.01)

(58) Field of Classification Search

CPC ... F01D 5/02; F01D 5/143; F01D 5/06; F01D 5/08; F01D 5/081; F01D 11/001; F01D 11/02; F01D 11/04; F01D 11/005; F01D 11/006; F01D 9/041; F01D 25/24; F01D 11/122; F01D 11/125; F01D 11/127; F04D 29/542; F04D 29/164; F05D 2240/12; F05D 2240/80

USPC .... 415/173.1, 173.4, 115, 116, 173.7, 174.4, 415/174.5

See application file for complete search history.

(56) References Cited

U.S. PATENT DOCUMENTS

| | | | | |
|---|---|---|---|---|
| 4,662,820 | A | 5/1987 | Sasada et al. | |
| 5,096,376 | A | 3/1992 | Mason et al. | |
| 5,352,087 | A * | 10/1994 | Antonellis | F01D 11/001 415/115 |
| 5,462,403 | A | 10/1995 | Pannone | |
| 7,001,145 | B2 | 2/2006 | Coture et al. | |
| 8,402,741 | B1 | 3/2013 | Merry et al. | |

(Continued)

FOREIGN PATENT DOCUMENTS

| | | |
|---|---|---|
| EP | 0180533 | 5/1986 |

OTHER PUBLICATIONS

Extended European Search Report for European Application No. 16154890.4 dated Jun. 30, 2016.

*Primary Examiner* — Ian Paquette

(74) *Attorney, Agent, or Firm* — Carlson, Gaskey & Olds, P.C.

(57) ABSTRACT

A rotor includes a rotor hub that is rotatable about an axis. The rotor hub includes a bore portion and a rim. An arm extends axially and radially inwardly from the rim. The arm has a radially inner side, a radially outer side, and a protruding ramp on the radially outer side.

16 Claims, 4 Drawing Sheets

(56) References Cited

U.S. PATENT DOCUMENTS

| | | | | |
|---|---|---|---|---|
| 8,403,630 | B2 | 3/2013 | Guemmer | |
| 2006/0222485 | A1* | 10/2006 | Lardellier | F01D 5/145 415/115 |
| 2008/0310961 | A1 | 12/2008 | Guemmer | |
| 2009/0317232 | A1 | 12/2009 | Guemmer | |
| 2010/0008760 | A1 | 1/2010 | Morris et al. | |
| 2010/0196143 | A1 | 8/2010 | Walker | |
| 2012/0297790 | A1 | 11/2012 | Alvanos et al. | |
| 2012/0301275 | A1 | 11/2012 | Suciu et al. | |
| 2013/0064673 | A1 | 3/2013 | Domercq et al. | |
| 2014/0248122 | A1 | 8/2014 | Vetters et al. | |
| 2015/0167543 | A1* | 6/2015 | Takata | F01D 11/04 415/184 |
| 2016/0010460 | A1* | 1/2016 | Alavanos | F01D 5/143 415/208.1 |

* cited by examiner

ROTOR WITH AXIAL ARM HAVING PROTRUDING RAMP

BACKGROUND

A gas turbine engine can include a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Rotors in the compressor section can be assembled from a disk that has a series of slots that receive and retain respective rotor blades. Another type of rotor is an integrally bladed rotor, sometimes referred to as a blisk. In an integrally bladed rotor, the disk and blades are formed from a single piece or are welded together as a single piece. Vanes are provided between the rotors to direct air flow. One type of vane is cantilevered from its radially outer end. The inner end may have a shroud. One or more seals can be provided at the inner end shroud; however, a small amount of gas path air downstream of the vanes can enter a cavity under the inner end shroud and escape past the seals.

SUMMARY

A rotor according to an example of the present disclosure includes a rotor hub rotatable about an axis and including a bore portion and a rim. An arm extends axially and radially inwardly from the rim. The arm has a radially inner side, a radially outer side, and a protruding ramp on the radially outer side.

In a further embodiment of any of the foregoing embodiments, the protruding ramp has a first section proximate the rim and a second section that slopes radially outwards from the first section.

In a further embodiment of any of the foregoing embodiments, the protruding ramp includes a first section that has a curvature and a second section that is substantially flat and that extends from the first section.

In a further embodiment of any of the foregoing embodiments, the second section slopes radially outwards from the first section.

In a further embodiment of any of the foregoing embodiments, the arm includes a protruding knife edge seal spaced apart from the protruding ramp, and an apex end of the protruding ramp is radially equal to or outboard of a tip end of the protruding knife edge seal.

In a further embodiment of any of the foregoing embodiments, the arm includes a protruding knife edge seal spaced apart from the protruding ramp, and the protruding ramp is sloped in a direction with respect to a tip end of the protruding knife edge seal.

In a further embodiment of any of the foregoing embodiments, the arm includes a seal member spaced apart from the protruding ramp, and the protruding ramp is sloped in a direction with respect to the seal member.

In a further embodiment of any of the foregoing embodiments, the protruding ramp has an angle, relative to the axis, of approximately 0° to approximately 40°.

A gas turbine engine according to an example of the present disclosure includes forward and aft rotors rotatable about an axis. The aft rotor includes a rotor hub rotatable about an axis and including a bore portion and a rim, and an arm extending axially and radially inwardly from the rim. The arm has a radially inner side and a radially outer side and a row of stator vanes axially between the forward and aft rotors. Each of the stator vanes includes a platform having a first radial side and a second radial side, and a platform axial leading end and a platform axial trailing end. An airfoil portion extends radially outwardly from the first radial side. A cavity extends from an inlet, between the arm and the platform along the second side, to an outlet. The inlet is between the row of stator vanes and the aft rotor and the outlet is between the row of stator vanes and the forward rotor. The arm includes a protruding ramp on the radially outer side.

In a further embodiment of any of the foregoing embodiments, the protruding ramp has a first section proximate the rim and a second section that slopes radially outwards from the first section.

In a further embodiment of any of the foregoing embodiments, the protruding ramp includes a first section that has a curvature and a second section that is substantially flat and that extends from the first section.

In a further embodiment of any of the foregoing embodiments, the second section slopes radially outwards from the first section.

In a further embodiment of any of the foregoing embodiments, the arm includes a protruding knife edge seal spaced apart from the protruding ramp, and an apex end of the protruding ramp is radially outboard of a tip end of the protruding knife edge seal.

In a further embodiment of any of the foregoing embodiments, the arm includes a protruding knife edge seal spaced apart from the protruding ramp, and the protruding ramp is sloped in a direction with respect to a tip end of the protruding knife edge seal.

In a further embodiment of any of the foregoing embodiments, the arm includes a seal member spaced apart from the protruding ramp, and the protruding ramp is sloped in a direction with respect to the seal member.

In a further embodiment of any of the foregoing embodiments, the protruding ramp has an angle, relative to the axis, of approximately 0° to approximately 40°.

In a further embodiment of any of the foregoing embodiments, the axial trailing end of the platform includes a rear axial face extending from the first radial side and a radially sloped face extending from the rear axial face to the second radial side, and the protruding ramp is angled in a direction toward the radially sloped face.

A method for use with a rotor according to an example of the present disclosure includes providing a rotor that includes a rotor hub that is rotatable about an axis and that has a bore portion and a rim, and an arm that extends axially and radially inwardly from the rim. The arm has a radially inner side, a radially outer side, and a protruding ramp on the radially outer side and uses the protruding ramp to vault gas that is flowing along the radially outer side off of the radially outer side as a directed stream of gas.

A further embodiment of any of the foregoing embodiments includes providing a stator vane that includes a platform that has a first radial side and a second radial side, and a platform axial leading end and a platform axial trailing end. The axial trailing end includes a rear axial face that extends from the first radial side and a radially sloped face that extends from the rear axial face to the second radial side, and an airfoil portion that extends radially outwardly from the first radial side and uses the radially sloped face to receive the directed stream of gas and deflect the directed stream of gas along the second radial side of the platform.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
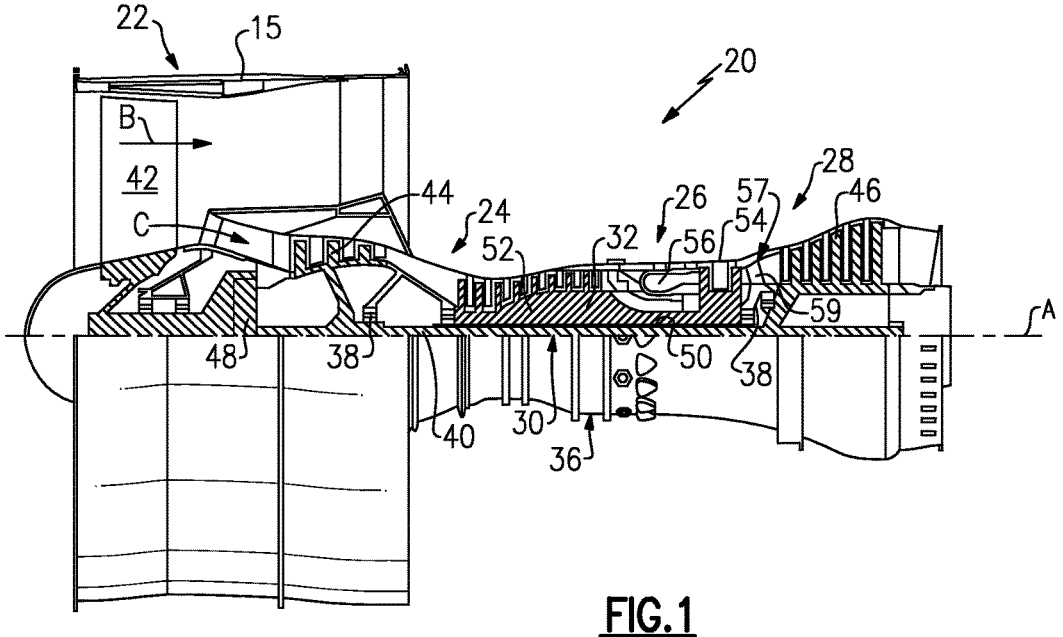
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engine designs can include an augmentor section (not shown) among other systems or features.

The fan section 22 drives air along a bypass flow path B in a bypass duct defined within a nacelle 15, while the compressor section 24 drives air along a core flow path C for compression and communication into the combustor section 26 then expansion through the turbine section 28. Although depicted as a two-spool turbofan gas turbine engine in the disclosed non-limiting embodiment, the examples herein are not limited to use with two-spool turbofans and may be applied to other types of turbomachinery, including direct drive engine architectures, three-spool engine architectures, and ground-based turbines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48, to drive the fan 42 at a lower speed than the low speed spool 30.

The high speed spool 32 includes an outer shaft 50 that interconnects a second (or high) pressure compressor 52 and a second (or high) pressure turbine 54. A combustor 56 is arranged between the high pressure compressor 52 and the high pressure turbine 54. A mid-turbine frame 57 of the engine static structure 36 is arranged generally between the high pressure turbine 54 and the low pressure turbine 46. The mid-turbine frame 57 further supports the bearing systems 38 in the turbine section 28. The inner shaft 40 and the outer shaft 50 are concentric and rotate via bearing systems 38 about the engine central longitudinal axis A, which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1. It should be understood, however, that the above parameters are only exemplary of one embodiment of a geared architecture engine and that the present invention is applicable to other gas turbine engines, including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft, with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of $[(\text{Tram}^\circ\ \text{R})/(518.7^\circ\ \text{R})]^{0.5}$. The "Low corrected fan tip speed" as disclosed herein according to one non-limiting embodiment is less than about 1150 ft/second.

In a further example, the fan 42 includes less than about 26 fan blades. In another non-limiting embodiment, the fan 42 includes less than about 20 fan blades. Moreover, in one further embodiment the low pressure turbine 46 includes no more than about 6 turbine rotors schematically indicated at 46*a*. In a further non-limiting example the low pressure turbine 46 includes about 3 turbine rotors. A ratio between the number of blades of the fan 42 and the number of low pressure turbine rotors 46*a* is between about 3.3 and about 8.6. The example low pressure turbine 46 provides the driving power to rotate the fan section 22 and therefore the relationship between the number of turbine rotors 46*a* in the low pressure turbine 46 and the number of blades in the fan section 22 discloses an example gas turbine engine 20 with increased power transfer efficiency.

Figure 2:
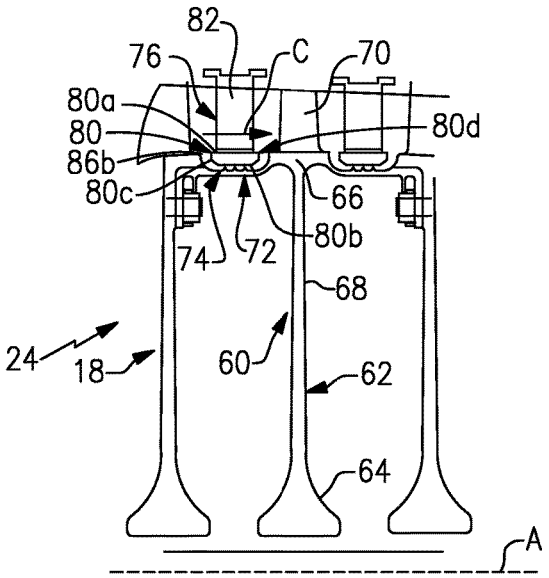
FIG. 2 illustrates selected portion of a compressor section of the engine of FIG. 1.

FIG. 2 illustrates selected portions of the compressor section 24 of the engine 20. In this example, the compressor section 24 includes a rotor 60. The rotor 60 is rotatable about the engine central axis A and includes a rotor hub portion 62. The rotor hub portion 62 at least includes a bore portion 64 and a rim 66. In this example, there is a relatively narrow portion 68 that connects the bore portion 64 and the rim 66.

A plurality of blades 70 extend radially outwardly from the rim 66. It is to be understood that directional terms, such as "radial," "axial," "circumferential" and variations thereof are with respect to the engine central axis A. With regard to the blades 70, the rotor 60 can be an integrally bladed rotor or an assembled rotor. An integrally bladed rotor is formed of a single piece of material, which thus provides the blades 70 and the hub portion 62. For example, the integrally bladed rotor is a monolithic piece that is forged or machined from a single solid work piece. Alternatively, the integrally bladed rotor can be formed of several pieces that are initially separate but then are welded or otherwise metallurgically bonded together to form a single, unitary piece. An assembled rotor includes at least several, distinct pieces that are mechanically secured together rather than metallurgically bonded or integral. For example, in an assembled rotor, the blades 70 are mechanically retained in slots on the rim 66.

The rotor 60 includes an arm 72 that extends generally axially from the rim 66. In this example, the portion of the arm 72 proximate the rim 66 extends axially and radially inward from the rim 66. The arm 72 also includes one or more seal members 74, such as knife edge seals, that serve to provide a seal in cooperation with a stator vane 76.

A row of the stator vanes 76 is arranged forward of the rotor 60 such that the row of stator vanes 76 is located axially between a forward rotor 78 and the rotor 60, which in this example is an aft rotor.

Figure 3:
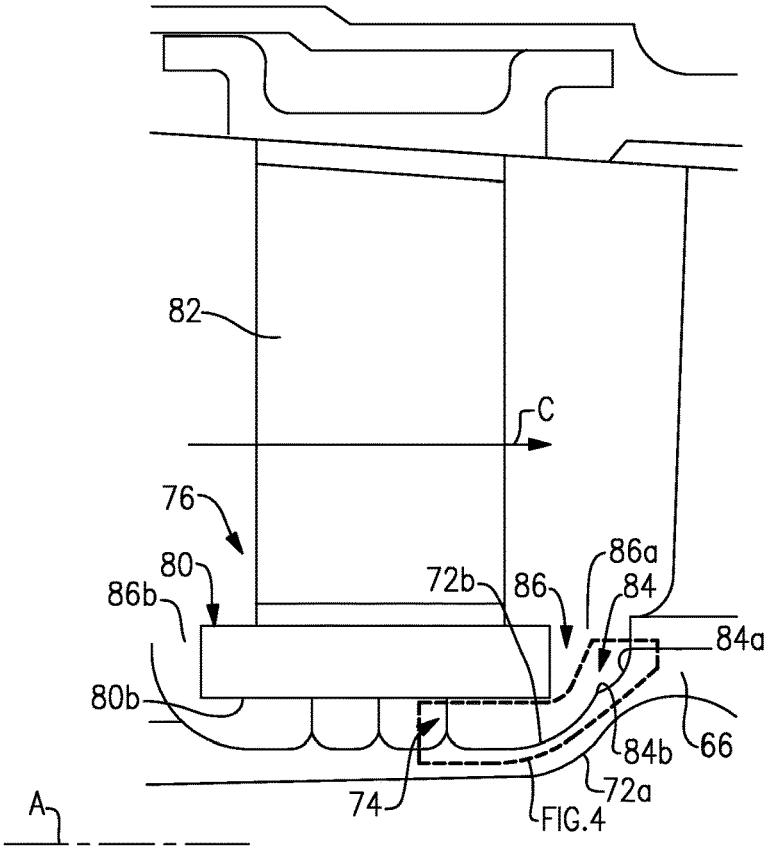
FIG. 3 illustrates a shrouded cavity between a stator vane and an arm of a rotor.
Figure 4:
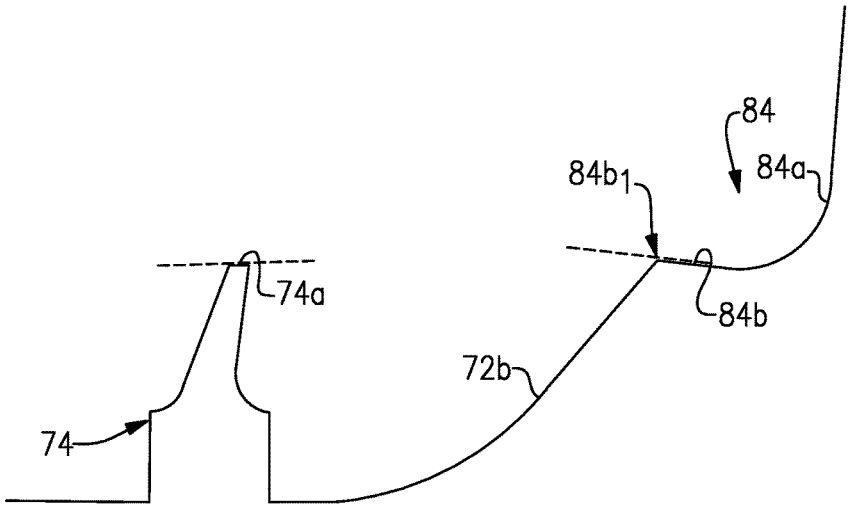
FIG. 4 illustrates a protruding ramp on the arm of the rotor of FIG. 3.

Each of the stator vanes 76 includes a platform 80 at its radially inner end. The platform 80 has a first radial side 80*a* and a second radial side 80*b*, and a platform axial leading end 80*c* and a platform axial trailing end 80*d*. An airfoil portion 82 extends radially outwardly from the first radial side 80*a* of the platform 80. The airfoil portion 82 and the first radial side 80*a* are thus directly exposed in the core airflow path C. Referring also to FIGS. 3 and 4, the arm 72 of the rotor 60 has a radially inner side 72*a* and a radially outer side 72*b*, relative to the engine central axis A. The arm 72 has a protruding ramp 84 on the radially outer side 72*b*.

Figure 5:
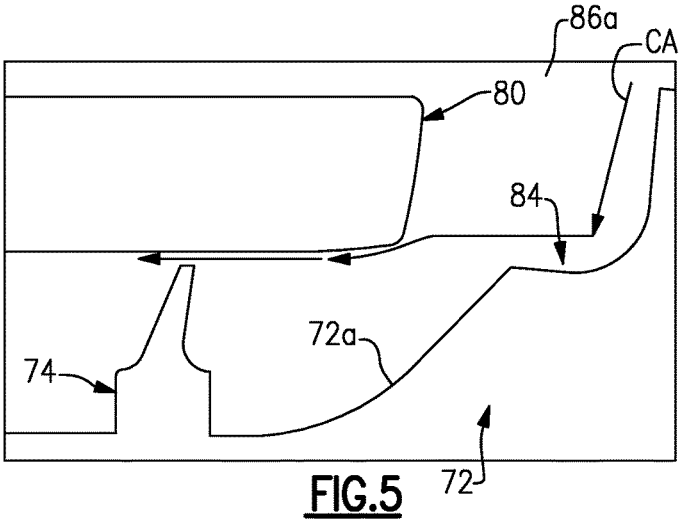
FIG. 5 illustrates the protruding ramp vaulting air off of the arm.

Referring also to FIG. 5, during operation of the engine 20, compressed air from the core airflow path C can enter a cavity 86 that extends around the platform 80 of the stator vanes 76. This cavity 86 can also be referred to as a shrouded cavity. The cavity 86 extends from an inlet 86*a*, between the arm 72 and the platform 80 and along the second radial side 80*b*, to an outlet 86*b* forward of the platform 80. The inlet 86*a* is between the stator vanes 76 and the aft rotor 60. The outlet 86*b* is located between the stator vanes 76 and the forward rotor 78.

During engine operation, compressed air, generally represented at CA, can enter shrouded cavities. If the air is permitted to reside in the cavity and swirl or if the air is permitted to travel along the rotor, the rotation of the rotor can frictionally heat the air, which can in turn contribute to increasing the temperature in the compressor section. However, in the cavity 86, this air is instead guided in a controlled manner along the stator vanes 76 to reduce frictional heating at the rotor 60, and thus facilitate thermal management of the compressor section 24.

In the illustrated example, the air entering the cavity 86 initially travels along the radially outer surface 72*b* of the arm 72. But for the protruding ramp 84, this air would continue along the radially outer surface 72*b* of the arm and thus potentially be subjected to frictional heating. However, rather than continuing to travel along the radially outer surface 72*b*, the protruding ramp 84 vaults the air off of the radially outer surface 72*b*, directing the air toward the platform 80 of the stator vane 76. The air can then travel along the stator vane platform 80 rather than along the spinning arm 72 of the rotor 60.

The protruding ramp 84 need only be steep enough to dislodge the air from the radially outer surface 72*b* such that the air is directed as a stream toward the platform 80. For example, the protruding ramp 84 is configured such that it is radially sloped either toward the platform 80 or toward a gap between the seal member 74 and the second radial side 80*b* of the platform 80. In further examples, the slope angle of the protruding ramp 84 is within +/−20° of the direction that intersects the gap between the seal member 74 and the second radial side 80*b* of the platform 80. In further examples, the slope of the protruding ramp 84 can have an angle, relative to the engine central axis A, of approximately 0° to approximately 40°.

In a further example, the protruding ramp 84 has a first section 84*a* that is proximate the rim 66 and a second section 84*b* that extends from the first section 84*a*. For example, the first section 84*a* has a curvature and the second section 84*b* is substantially flat such that the air initially traveling into the cavity 86 along the radially outer surface 72*b* encounters the first section 84*a*. The curvature of the first section 84*a* smoothly redirects the air toward the second section 84*b*. The air then travels over the second section 84*b* to an apex end $\mathbf{84}b_1$ of the protruding ramp 84 before being vaulted off of the radially outer surface 72*b* toward the platform 80. The apex end $\mathbf{84}b_1$ in this example includes a relatively abrupt corner, to facilitate dislodging the air from the radially outer surface 72*b*.

In one further example, the second section 84*b* slopes radially outward from the first section 84*a*. In this manner, the air from the first section 84*a* is gradually redirected and turned radially upward to be vaulted off of the protruding ramp 84*a* toward the platform 80. For example, the radially outward slope of the second section 84*b* further facilitates dislodging the air from the radially outer surface 72*b*.

In a further example, the apex end $\mathbf{84}b_1$ is located at a radial position relative to a tip end 74*a* of the seal member 74, which in this example is a knife edge seal. For instance, the apex end $\mathbf{84}b_1$ is radially equal to or outboard of the tip end 74*a*, relative to engine central axis A. Such a location serves to smoothly direct the air toward the platform 80 or gap between the tip end 74*a* and the second radial side 80*b* of the platform 80.

Figure 6:
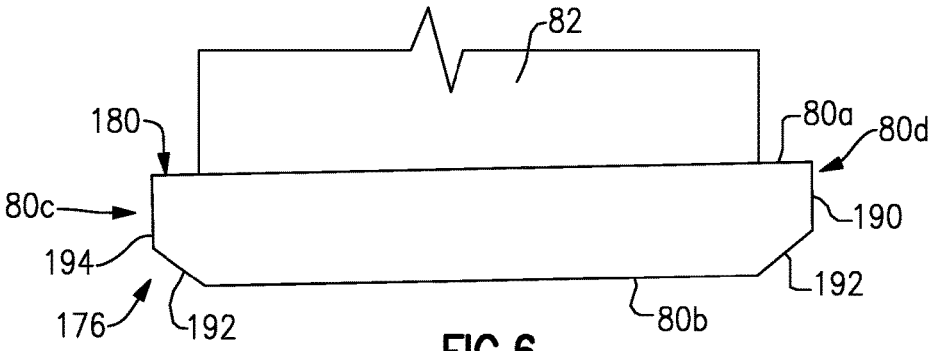
FIG. 6 illustrates an example platform of a stator vane that has a sloped face.

FIG. 6 shows another example of a selected portion of a stator vane 176. In this example, the stator vane 176 includes a platform 180 that has features for facilitating flow of air along the platform 180 rather than along the arm of a rotor. In this example, the axial trailing end 80*d* of the platform 180 includes a rear axial face 190 that extends from the first radial side 80*a* and a radially sloped face 192 that extends from the rear axial face 190 to the second radial side 80*b*. Optionally, the axial forward end 80*c* of the platform 180 also includes a similar geometry with a radially sloped face 192 extending from a forward axial face 194 to the second radial side 80*b*.

Figure 7:
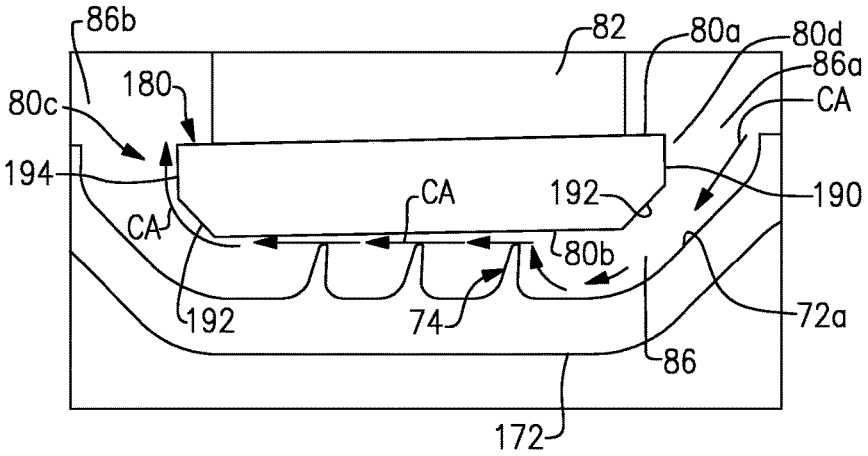
FIG. 7 illustrates the sloped face or faces of a platform facilitating flow through a shrouded cavity.

Referring to FIG. 7, the radially sloped faces 192 facilitate flow of the compressed air CA in the cavity 86 along the platform 180 rather than along the radially outer surface 72*a* of the arm 172. For example, the air entering the cavity 86 initially may flow along the radially outer surface 72*a* but is then directed outwardly toward the second radial surface 80*b* of the platform 180 by the first seal member 74. The radially sloped face 192 at the axial trailing end 80*d* of the platform 180 facilitates smooth flow around the axial trailing end to reduce churning of the air flow, which may increase residence in the cavity 86. Once the air flows through the gaps between the seal members 74 and the second radial side 80*b* of the platform 80, the radially sloped face 192 at the axial forward end 80*c* also facilitates smooth flow around the axial forward end 80*c*. For example, if there were instead a square corner at the axial forward end 80*c*, the flow would be more likely to continue forward and impinge upon the arm 172 rather than flow along the platform 180 to the outlet of the cavity 86.

Figure 8:
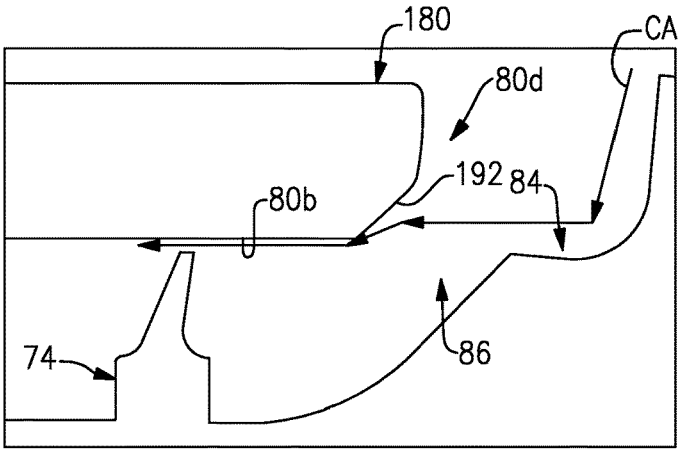
FIG. 8 illustrates a further example that has a platform with a sloped face and a rotor with an arm having a protruding ramp.

The protruding ramp 84 and the radially sloped face or faces 192 can be used alone or in combination to further facilitate controlling the flow of the compressed air. For example, FIG. 8 illustrates an example that includes both the protruding ramp 84 and the radially sloped face 192 at the axial trailing end 80*d* of the platform 180. In this example, the protruding ramp 84 is configured to direct a stream of air toward the platform 180, and the radially sloped face 192 is situated to receive at least a portion of the directed stream of gas and deflect it along the second radial side 80*b* of the platform 180. That is, the radially sloped face 192 is angled with regard to the angle of the protruding ramp 84, to receive at least a portion of the directed stream of gas. In this way, the protruding ramp 84 and the radially sloped face 192 cooperatively control air flow through the cavity 86 to reduce frictional heating and thus facilitate thermal management.

In instances where the stream is directed toward the gap between the seal member 74 and the second radial side 80*b*, the radially sloped face 192 may receive and deflect only a portion of the directed stream of gas. In further examples, the radially sloped face 192 can have an angle, relative to the engine central axis A, of approximately 15° to approximately 60° to facilitate deflection. In yet further examples, the angle is approximately 30° to approximately 45°. Generally, steeper angles may be less effective for deflecting, but permit the platform to be more compact. Thus, in at least some examples, the angle of approximately 30° to approximately 45° represents a balance between deflection and size.

Figure 9:
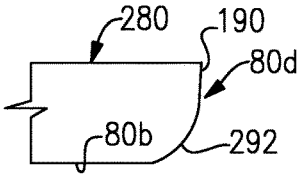
FIG. 9 illustrates an example platform with a curved sloped face.
Figure 10:
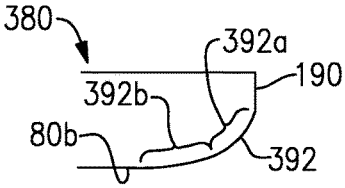
FIG. 10 illustrates an example platform with a complex curved sloped face.

The radially sloped face or faces 192 are depicted as being substantially flat in the above examples, at least within acceptable tolerances in the field. However, in one variation, as shown in FIG. 9, the platform 280 has a curved radially sloped face 292. For example, the curvature of the radially sloped face 292 is parabolic. In another example, the curvature has a single, exclusive radius of curvature. In another example shown in FIG. 10, the radially sloped face 392 of the platform 380 has a complex curvature with multiple radii of curvature. For instance, the radially sloped face 392 has a first section 392*a* proximate the rear axial face 190 and a second section 392*b* proximate the second radial side 80*b*, where the first section 392*a* has a first curvature and the second section 392*b* has a second curvature that is less than the first curvature.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A rotor comprising:

a rotor hub rotatable about an axis and including a bore portion and a rim;

a plurality of blades extending radially outwards from the rim, each said blade having forward and trailing ends; and an arm having a sloped portion extending axially forward radially inwardly from a forward side of the rim, the arm having a radially inner side, a radially outer side, and a protruding ramp on the radially outer side of the sloped portion, the protruding ramp having a first section proximate the rim and a second section that slopes radially outwards from the first section.

2. The rotor as recited in claim 1, wherein the first section has a curvature and the second section is substantially flat.

3. The rotor as recited in claim 1, wherein the arm includes a protruding knife edge seal spaced apart from the protruding ramp, and an apex end of the protruding ramp is radially equal to or outboard of a tip end of the protruding knife edge seal.

4. The rotor as recited in claim 1, wherein the arm includes a protruding knife edge seal spaced apart from the protruding ramp, and the protruding ramp is sloped in a direction with respect to a tip end of the protruding knife edge seal.

5. The rotor as recited in claim 1, wherein the arm includes a seal member spaced apart from the protruding ramp, and the protruding ramp is sloped in a direction with respect to the seal member.

6. The rotor as recited in claim 1, wherein the protruding ramp has an angle, relative to the axis, of approximately 0° to approximately 40°.

7. A gas turbine engine comprising:

forward and aft rotors rotatable about an axis, the aft rotor including, a rotor hub rotatable about an axis and including a bore portion and a rim, and an arm extending axially and radially inwardly from the rim, the arm having a radially inner side and a radially outer side;

a row of stator vanes axially between the forward and aft rotors, each of the stator vanes including, a platform having a first radial side and a second radial side, and a platform axial leading end and a platform axial trailing end, and an airfoil portion extending radially outwardly from the first radial side, a cavity extending from an inlet, between the arm and the platform along the second side, to an outlet, the inlet being between the row of stator vanes and the aft rotor and the outlet being between the row of stator vanes and the forward rotor, the arm including a protruding ramp on the radially outer side, the protruding ramp having a first section proximate the rim and a second section that slopes radially outwards from the first section, wherein the axial trailing end of the platform includes a rear axial face extending from the first radial side and a radially sloped face extending from the rear axial face to the second radial side, and the protruding ramp is angled in a direction toward the radially sloped face.

8. The gas turbine engine as recited in claim 7, wherein the first section has a curvature and a second section is substantially flat.

9. The gas turbine engine as recited in claim 7, wherein the arm includes a protruding knife edge seal spaced apart from the protruding ramp, and an apex end of the protruding ramp is radially outboard of a tip end of the protruding knife edge seal.

10. The gas turbine engine as recited in claim 7, wherein the arm includes a protruding knife edge seal spaced apart from the protruding ramp, and the protruding ramp is sloped in a direction with respect to a tip end of the protruding knife edge seal.

11. The gas turbine engine as recited in claim 7, wherein the arm includes a seal member spaced apart from the protruding ramp, and the protruding ramp is sloped in a direction with respect to the seal member.

12. The gas turbine engine as recited in claim 7, wherein the protruding ramp has an angle, relative to the axis, of approximately 0° to approximately 40°.

13. The gas turbine engine as recited in claim 7, wherein the arm includes a seal member spaced apart from the protruding ramp, and the protruding ramp is sloped in a direction toward a gap between the seal member and the second radial side of the platform.

14. A gas turbine engine comprising forward and aft rotors rotatable about an axis, the aft rotor including, a rotor hub rotatable about an axis and including a bore portion and a rim, and an arm extending axially and radially inwardly from the rim, the arm having a radially inner side and a radially outer side;

a row of stator vanes axially between the forward and aft rotors, each of the stator vanes including, a platform having a first radial side and a second radial side, and a platform axial leading end and a platform axial trailing end, and an airfoil portion extending radially outwardly from the first radial side, a cavity extending from an inlet, between the arm and the platform along the second side, to an outlet, the inlet being between the row of stator vanes and the aft rotor and the outlet being between the row of stator vanes and the forward rotor, the arm including a protruding ramp on the radially outer side, the protruding ramp having a first section proximate the rim and a second section that slopes radially outwards from the first section wherein the radially sloped face has a first section proximate the rear axial face and a second section proximate the second radial side, the first section having a first curvature and the second section having a second curvature that is less than the first curvature.

15. The gas turbine engine as recited in claim 14, wherein the radially sloped face is parabolic.

16. A gas turbine engine comprising:

forward and aft rotors rotatable about an axis, the aft rotor including, a rotor hub rotatable about an axis and including a bore portion and a rim, and an arm extending axially and radially inwardly from the rim, the arm having a radially inner side and a radially outer side;

a row of stator vanes axially between the forward and aft rotors, each of the stator vanes including, a platform having a first radial side and a second radial side, and a platform axial leading end and a platform axial trailing end, and an airfoil portion extending radially outwardly from the first radial side, a cavity extending from an inlet, between the arm and the platform along the second side, to an outlet, the inlet being between the row of stator vanes and the aft rotor and the outlet being between the row of stator vanes and the forward rotor, the arm including a protruding ramp on the radially outer side, the protruding ramp having a first section proximate the rim and a second section that slopes radially outwards from the first section, wherein the radially sloped face has an angle, relative to the axis, of approximately 15° to approximately 60° and the protruding ramp has an angle, relative to the axis, of approximately 20° to approximately 40°.

* * * * *